United States Patent [19]

Muller

[11] Patent Number: 4,742,591

[45] Date of Patent: May 10, 1988

[54] CABLE STAYED BRIDGE HAVING BOX EDGE BEAMS AND METHOD OF CONSTRUCTION

[75] Inventor: Jean M. Muller, Tallahassee, Fla.

[73] Assignee: Figg and Muller Engineers, Inc., Tallahassee, Fla.

[21] Appl. No.: 106,028

[22] Filed: Oct. 8, 1987

Related U.S. Application Data

[63] Continuation of Ser. No. 818,970, Jan. 15, 1986, abandoned.

[51] Int. Cl.[4] ..... E01D 11/00; E01D 21/04

[52] U.S. Cl. ..... 14/1; 14/18; 14/19; 14/16.5

[58] Field of Search ..... 14/1, 6, 16.5, 17-20, 14/23, 73; 52/223 R, 227, 228, 396, 573, 731; 404/47, 54

[56] References Cited

U.S. PATENT DOCUMENTS

| | | | |
|---|---|---|---|
| 1,427,557 | 8/1922 | Smith | 404/54 |
| 2,336,622 | 12/1943 | Le Tourneau | 14/1 X |
| 2,380,183 | 7/1945 | Maney | 14/18 |
| 3,132,363 | 5/1964 | Roberts | 14/18 |
| 3,504,389 | 4/1970 | Longbottom | 14/27 X |
| 3,975,476 | 8/1976 | Finsterwalder | 14/23 X |
| 4,114,219 | 9/1978 | Schambeck | 14/1 X |

FOREIGN PATENT DOCUMENTS

| | | | |
|---|---|---|---|
| 108790 | 4/1966 | Norway | 14/18 |
| 277564 | 12/1951 | Switzerland | 14/1 |

*Primary Examiner*—George A. Suchfield
*Assistant Examiner*—Matthew Smith
*Attorney, Agent, or Firm*—Watson, Cole, Grindle & Watson

[57] ABSTRACT

A cable stayed bridge construction having box edge beams to which the deck structure is joined between the top and bottom thereof, and to which the cable stays are anchored.

9 Claims, 2 Drawing Sheets

CABLE STAYED BRIDGE HAVING BOX EDGE BEAMS AND METHOD OF CONSTRUCTION

This application is a continuation of application Ser. No. 818,970, filed Jan. 15, 1986, now abandoned.

BACKGROUND OF THE INVENTION

This invention relates generally to a cable stayed bridge, and more particularly to such bridge having box edge beams to which the cable stays are connected.

A known cable stayed bridge construction may include longitudinal I-beams located at the underside of a reinforced concrete deck adjacent opposite sides of the deck, spaced apart transverse floor beams underlying the deck and joined at opposite ends to the longitudinal I-beams, cable stays anchored to selected floor beams for supporting the deck structure from the pylons, and crash barrier walls provided on the upper surface of the deck inwardly of the cable stays.

There is the need to improve upon such a cable stayed bridge construction in a number of ways. For example, the bridge could be improved, especially for long spans, to enhance longitudinal and torsional rigidity and to withstand the forces of strong wind. Options should be available for longitudinal side beams other than steel, such as reinforced concrete or a composite of concrete and steel. Improved resistance to buckling needs to be devised, and aerodynamic stability of the bridge would offer a much improved resistance to wind. The bridge structure should allow for convenient and effective placement, stressing, adjustment and replacement of the cable stays without compromising bridge rigidity. And, compensation should be made for long-term concrete strains due to shrinkage and creep, while at the same time compensating for long-term stress to which the steel structural beams are subjected. An improved method of bridge construction for efficiency and economy, is also desirable.

SUMMARY OF THE INVENTION

It is therefore an object of the present invention to provide a cable stayed bridge construction and method which employs box edge beams arranged in such a manner as to improve upon standard cable stayed bridge construction taking into account all the needs experienced over the years as discussed above, while at the same time providing a cable stayed bridge construction which is relatively easy to fabricate and erect, highly efficient and economical, is significantly less time consuming, and reduces the need for heavy and special equipment, compared to prior art bridge constructions.

In keeping with this general objective, the cable stayed bridge construction of the invention provides for longitudinally extending hollow box beams along opposite side edges of a reinforced concrete deck structure, spaced transverse floor beams spanning the deck therebelow and joined at opposite ends to the box beams, cable stays supporting the bridge deck from pylons, the cable stays connecting with the box beams at the opposite sides of the deck. Each of the box beams has an inner side wall, spaced top and bottom walls and a spaced outer side wall, these walls defining a hollow space and the box beams providing longitudinal stability and torsional rigidity to the bridge and resistance to buckling. The inner side wall of each of the box beams is joined to each of the side edges of the deck at a location between the top and bottom walls so as to present an upper section of the inner wall of the box beam which defines a crash barrier wall, the floor beams being joined to the box beams at a lower section of the inner wall thereof.

Each of the box beams may be substantially D-shaped in cross-section such that the outer wall thereof is curved for providing aerodynamic stability to the bridge.

Designated pairs of the box beams have confronting ends at the opposite sides of the deck structure may define expansion joints, one of such ends having an elongated arm extending into the hollow space of the confronting box beam which has longitudinally spaced internal abutments bearing against the arm so as to permit longitudinal shifting into relative displacement between the confronting ends while allowing bending moments to be transferred through at the expansion joints.

The box beams at opposite side edges of the deck structure may comprise a plurality of aligned box beam segments, and sections of the concrete deck structure extend between opposed pairs of such segments and form modules together with the segments, the modules being joined together end-to-end.

Each of the modules may be assembled together by applying pretension forces to the opposed pair of box beam segments and applying opposed precompression forces to the intermediate deck section, after which the box beam segments are joined to the opposite ends of the underlying floor beams and to the side edges of the concrete section prior to release of the applied forces.

Other objects, advantages and novel features of the invention will become more apparent from the following detailed description of the invention when taken in conjunction with the accompanying drawings.

DETAILED DESCRIPTION OF THE INVENTION

Figure 1:
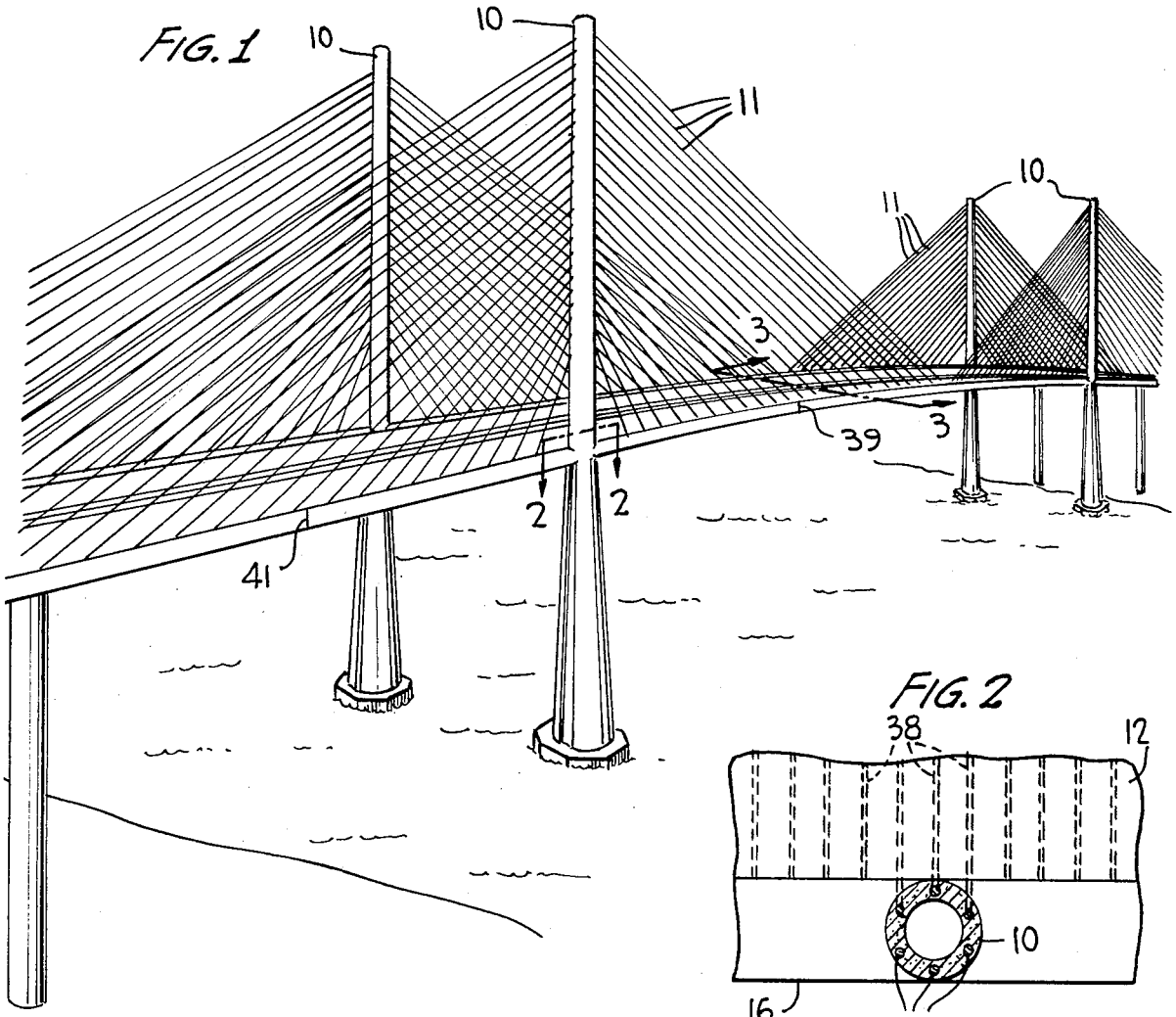
FIG. 1 is a perspective view of a cable stayed bridge incorporating the features of the invention.

Turning now to the drawings wherein like reference characters refer to like and corresponding parts throughout the several views, a cable stayed bridge incorporating the features of the invention is generally illustrated in FIG. 1 as comprising twin pylons 10 from which a plurality of cable stays 11 extend for supporting a deck structure 12 as in accordance with the following description.

Figure 3:
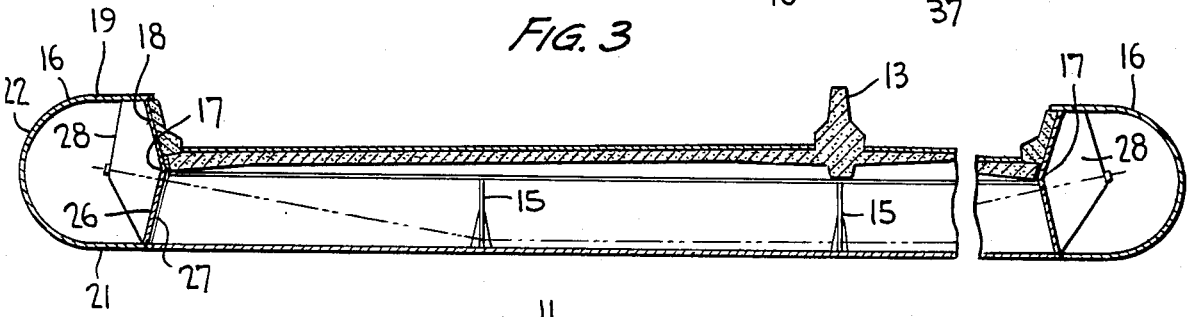
FIG. 3 is a cross-sectional view of the deck structure, box edge beams and underlying floor beam, taken substantially along the line 3—3 of FIG. 1.
Figure 4:
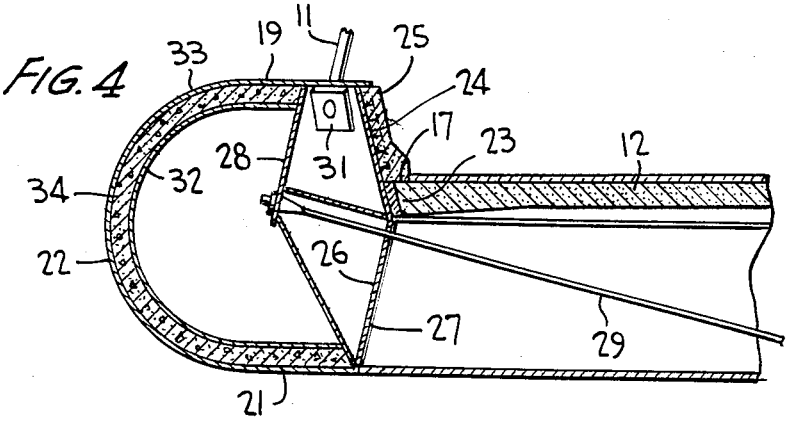
FIG. 4 is a slightly enlarged detail view similar to FIG. 3.
Figure 5:
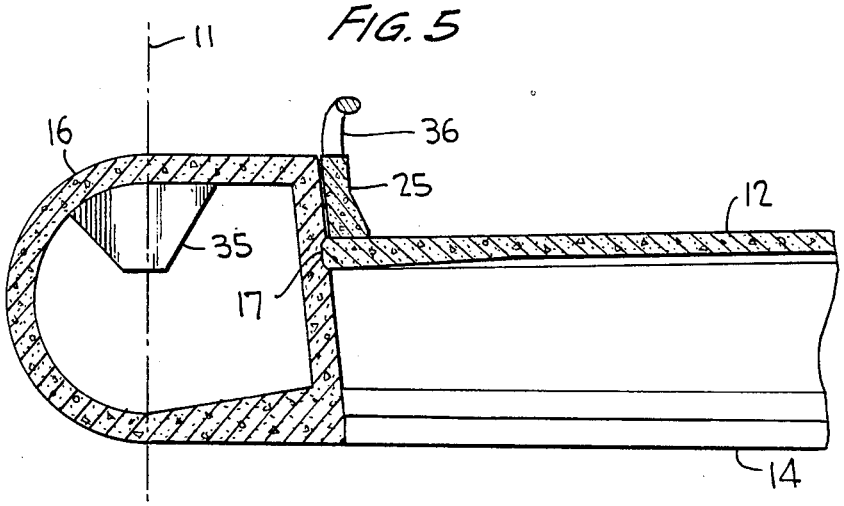
FIG. 5 is a view similar to FIG. 4 of a modification of a typical box edge beam.

Deck structure 12 is of reinforced concrete which may be cast in place as having a central crash barrier 13. Transverse floor beams 14, spaced a predetermined distance apart, underlie the deck. Box edge beams 16, which may be of steel, are located at opposite side edges 17 of the concrete deck, each box beam being of a predetermined length in one embodiment and having an inner side wall 18, a top wall 19, a bottom wall 21 and an outer side wall 22, the walls of the box beam defining a hollow space, as shown. Side edges 17 of the concrete deck are joined, as at 23, as by grouting or the like, to the inner side walls of the opposing box beams at a location between the top and bottom walls thereof at a predetermined distance from the top wall so as to provide an upper section 24 of the inner wall capable of supporting a crash barrier wall 25 which may be cast in place. And, opposite ends 26 of the transverse floor beams 14 may be joined to lower sections 26 of the inner side walls of the box beams as by welding 27. Anchor plates 28 bear against the inner surfaces of walls 18 for anchoring opposite ends of transverse post-tensioning tendons 29 which, when tensioned in some normal manner, produce the required camber for the deck. Such tendons 29 may be given a draped profile to increase their efficiency by proper deviation at the location of web stiffeners 15 of the steel floor beams. And, cable stays 11 are anchored as at 31 (FIG. 4) directly to the box beams at spaced distances. The cable stays are not shown in FIG. 3 but are otherwise anchored to the box beams similarly as shown in FIG. 4. And, the box beams of FIG. 4 differ from that of FIG. 3 only in that the top, bottom and outer side walls thereof comprise a composite of inner and outer layers 32 and 33 of steel and an intermediate layer of concrete 34. Otherwise, the box edge beams may be entirely of reinforced concrete as shown in FIG. 5. Whether of concrete or steel or a composite of concrete and steel, the box edge beams are shown as substantially D-shaped in cross-section such that the curved outer side walls thereof provide aerodynamic stability to the bridge for better resisting the forces of cross winds. However, the box edge beams may be of other cross-sectional shapes than shown, such as polygonal, circular, oval, or a combination of polygonal and curved, without departing from the invention. And, in the FIG. 5 box edge beam embodiment, the cable stays may be anchored to internal anchor plates 35, and side rails 36 may extend from walls 25 in FIGS. 3 and 4, as typically shown in FIG. 5.

Figure 2:
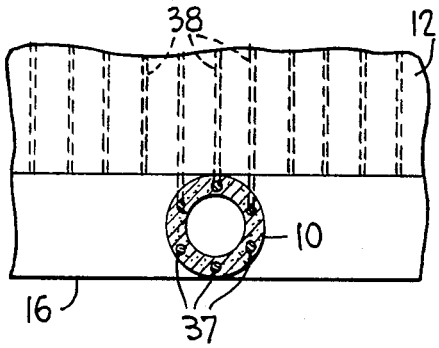
FIG. 2 is a sectional view taken substantially along the line 2—2 of FIG. 1.

The pylons are typically provided with longitudinally extending steel reinforcing bars 37, and the deck structure is typically provided with transversely extending steel reinforcing bars 38. Therefore, in the vicinity of the pylons, bars 38 may be integral with pylons bars 37, as shown in FIG. 2, for enhancing the structural integrity of the bridge.

Figure 6:
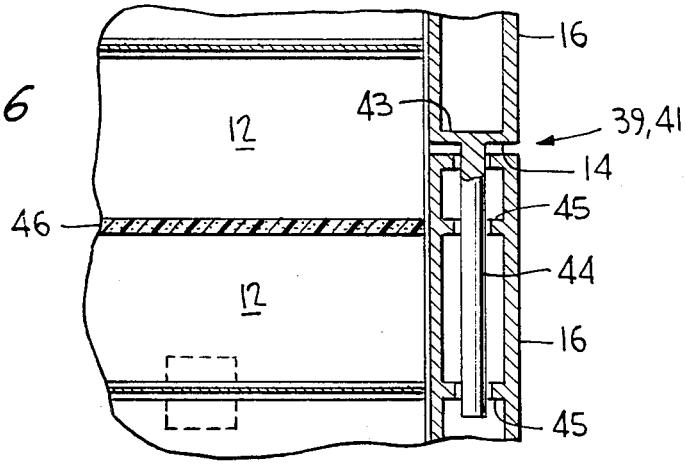
FIG. 6 is a horizontal sectional view of a typical expansion joint provided between adjoining sections of the deck structure and box edge beams.

At predetermined locations such as 39, 41 (FIG. 1) along the bridge, bridge expansion joints are defined at confronting ends 42 and 43 (FIG. 6) of aligned box edge beams. An elongated arm 44 extends from one of the ends into the hollow space of the adjoining beam through its confronting end and is received within spaced bearing plates 45 which permit relative longitudinal displacement between the confronting ends of the box beams while preventing bending moment transfer through the expansion joints. These bearing plates may be annular having suitable central openings for receiving the rod. And, a conventional expansion joint strip 46 may fill a gap between adjoining deck structures 12 at the expansion joints for accommodating bridge expansion.

Figure 7:
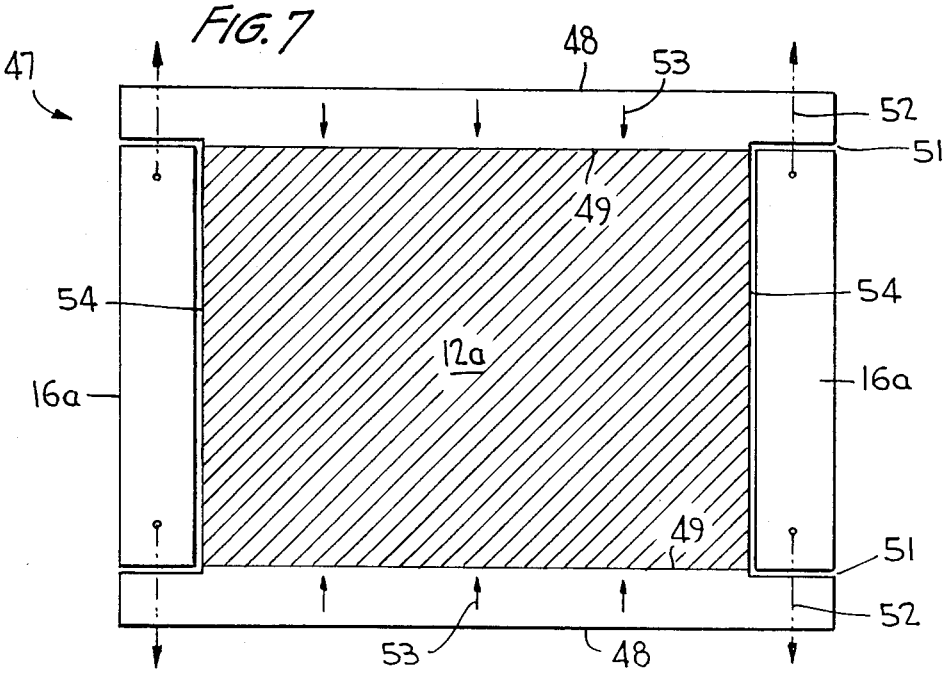
FIG. 7 is the top plan view illustrating the manner of assembling together a module of box edge beam segments and an intermediate concrete deck section.

Furthermore, the deck may be erected of adjoining modules 47, shown in FIG. 7 as comprising a pair of opposed box edge beam segments **16*a* and an intermediate deck section 12*a*. During fabrication of such module, the concrete deck section is cast in place overlying the cross floor beams and longitudinal support plates but is initially unattached to segments 16*a* which, in this case, are of steel. Opposing pressure platens 48 having centrally thickened sections 49, are brought to bear against the opposing ends of section 12*a* such that opposing ends of the platens are slightly spaced from segments 16*a* as at 51. Then, opposing forces in the direction of arrows 52 are applied at opposite ends of segments 16*a*, as by rods extending from these ends through the platen ends and tightening the platens down over the segments. The box edge beam segments are thus pretensioned while at the same time deck section 12*a* is subjected to compression forces in the direction of arrows 53. Gaps 54 between the deck section and the box edge beam segments are then filled at the appropriate time after the deck concrete has hardened and in some normal manner as at 23, the opposing ends of the transverse floor beams are joined to the lower sections 26 of the box edge beams as at welding 27, and forces 52 and 53 are released. The box edge beam sections are thus pretensioned, while the concrete deck section 12*a*** is precompressed for preventing long-term concrete strains due to shrinkage and creep. Thus, the tension forces which could occur during long-term concrete strains, and the compression strains to which the steel box beams are subjected to over a long term, are compensated one for the other by the aforedescribed assembling method for each module. The modules may then be connected end-to-end to form a continuous deck with each module being supported from the pylons by the cable stays.

From the foregoing it can be seen that a simple and efficient yet highly effective cable stayed bridge construction has been devised utilizing box edge beams which not only serve to expedite the bridge assembly procedure but provide torsional rigidity, aerodynamic stability and resistance to bridge buckling. Moreover, bridge deck rigidity is maintained while changing the cable stays, and the cable stays may be conveniently installed, stressed, adjusted and replaced as they are simply anchored to the box edge beams. And, upper sections of the opposing box edge beams provide crash barrier walls, and the hollow beams provide for easy and effective installation of expansion joints at opposite sides of the deck. Moreover, deck modules are capable of being assembled so as to compensate for tension and compression forces acting between the steel and concrete of the bridge deck.

Obviously, many modifications and variations of the present invention are made possible in the light of the above teachings. It is therefore to be understood that within the scope of the appended claims the invention may be practiced otherwise than as specifically described.

What is claimed is:

1. A cable stayed bridge comprising, a bridge deck having opposing side edges, bridge pylon structure extending above said deck, separate, longitudinally extending, hollow, structural box beams along said side edges of said deck, spaced transverse floor beams spanning said deck therebelow, said floor beams being joined at opposite ends respectively to said box beams, cable stays supporting the bridge from said pylon structure, said cable stays extending between said pylon structure and anchored directly to said box beams at said side edges of said deck, each of said box beams having an inner side wall, spaced top and bottom walls and a spaced outer side wall, said walls defining a hollow space and said box beams providing longitudinal stability and torsional rigidity to the bridge and resistance to buckling, said cable stays having ends extending through said top wall of each of said box beams, anchor means within said hollow space of said box beams engaging said ends of said cable stays for anchoring said cable stays to said box beams, said inner side wall of said box beams being joined to each of said side edgess of said deck at a location between said top and bottom walls to thereby present an upper section of said inner wall which defines a crash barrier wall, said floor beams being joined to said box beams at a lower section of said inner wall thereof.

2. The bridge according to claim 1, wherein each said box beam is substantaially D-shaped in cross-section such that said outer wall thereof is curved for providing aerodynamic stability and reduced drag to the bridge.

3. The bridge accordging to claim 1, wherein pairs of said box beams having confronting ends and located at said opposite sides define expansion joints, one of said confronting ends of one of said pairs having an elongated arm extending into the hollow space of the other of said pairs through said end thereof, and said other pair having longitudinally spaced interval abutments bearing against said arm permitting relative axial shifting between said confronting ends while allowing bending moment transfer at said joints.

4. The bridge according to claim 1, wherein said deck is of reinforced concrete, said box beams comprsiing a plurality of aligned box beam segments, sections of said concrete deck extending respectively between opposed pairs of said segments and forming modules together therewith, said modules being joined together end-to-end at said deck sections and at said box beams segments.

5. The bridge according to claim 4, wherein said box beam segments are of pre-tensioned steel and said deck sections are of pre-compressed concrete.

6. A method of constructing a cable stayed bridge comprising:

erecting bridge pylon structure;

supporting bridge deck structure from said pylon structure by a plurality of cable stays; said deck structure being formed by assembling together modules each comprising a reinforced concrete bridge deck section and a pair of longitudinal hollow box beam segments along opposite sides of said section, providing transverse floor beams underlying said deck section and extending between said box beam segments, before said assembling and suppporting steps, forming each of said modules by applying pretension forces to said pair of segments and applying opposed precompression forces to said section, joining together said pair of segments to opposite ends of said floor beams and to said side edges of said section, and thereafter releasing said applied forces, whereby any long-term concrete strains in said deck section due to shrinkage and creep are avoided;

interconnecting said modules together end-to-end such that said box beam segments of adjoining modules are aligned; and extending said cable stays from said pylon structure and anchoring said cable stays directly to said pair of box beam segments of said connected modules.

7. The method according to calim 6, wherein said providing step includes assembling each said box beam as having an inner side wall, spaced top and bottom walls and a spaced outer side wall, said walls defining a hollow space joining step including joining said deck section to said inner side wall of each said box beam between said top and bottom walls thereof to thereby present an upper section of said inner wall which defines a crash barrier wall, and further including joining said floor beams to said box beams at a lower section of said inner wall thereof, said extending step including extending ends of said cable stays through said top wall of each said box beam, and aid anchoring step including providing anchor means within said hollow space of each box beams for engaging said ends of said cable says.

8. The method according to claim 6, wherein said pretension and opposed precompression forces are applied simultaneously by using opposed pressure platens for each of said modules.

9. The method according to claim 6, comprising the further step of providing a bridge expansion joint between confronting ends of said box beams of a pair of said adjoining modules, by extending an elongated rod from one of said ends into the inside of the other of said confronting ends, and guiding said rod to permit relative longitudinal movement while avoiding bending at said expansion joint.

* * * * *